United States Patent [19]

Glasson et al.

[11] Patent Number: 4,552,075

[45] Date of Patent: Nov. 12, 1985

[54] SECURE CONTAINER, FOR EXAMPLE FOR BANKNOTES

[75] Inventors: Peter Glasson, Portsmouth; John Wood, Hampshire, both of England

[73] Assignee: De La Rue Systems Limited, London, England

[21] Appl. No.: 500,437

[22] Filed: Jun. 2, 1983

[30] Foreign Application Priority Data

Jun. 4, 1982 [GB] United Kingdom ..... 8216326

[51] Int. Cl.[4] ..... E05B 65/46

[52] U.S. Cl. ..... 109/52; 109/66; 109/59 R; 232/1 D; 312/333

[58] Field of Search ..... 109/19, 45, 47, 49.5, 109/50–52, 58.5, 59, 63.5; 232/1 D, 6, 12, 43.2; 70/63; 312/216, 333

[56] References Cited

U.S. PATENT DOCUMENTS

| | | | |
|---|---|---|---|
| 1,068,783 | 7/1913 | Kohler | 109/52 |
| 2,026,977 | 1/1936 | Jaeger | 109/59 |
| 4,186,977 | 2/1980 | Gilovich et al. | 109/52 |

*Primary Examiner*—Gary L. Smith
*Assistant Examiner*—Neill Wilson
*Attorney, Agent, or Firm*—Cushman, Darby & Cushman

[57] ABSTRACT

A secure container formed with an aperture and having a closure member movable to cover or uncover the aperture, and comprising actuating means for engagement by a releasing member in a dispensing, loading or unloading apparatus as the container is inserted into such apparatus, incorporates a lost-motion connection between the actuating means (10) and release mechanism (12, 21, 22, 23) for the closure member (24) and a direct connection between the actuating means and an internally pivoted lever (11), as a consequence of which when the container is inserted in the apparatus the lever (11) is moved to project through the side wall of the container before the closure member starts to open and similarly on withdrawal of the container the closure member is completely closed before the lever returns to its first position inside the container to allow withdrawal of the container form the apparatus to be completed.

4 Claims, 4 Drawing Figures

SECURE CONTAINER, FOR EXAMPLE FOR BANKNOTES

This invention relates to a secure container, for example for banknotes, to be placed in a dispenser. It is known to provide containers having a closure member which can be opened only after the container is pushed into a dispenser or loading/unloading apparatus having means which, on insertion of the container, operate the release mechanism for the closure member.

As an example, the dispensing apparatus may contain fixed probes so positioned that they enter the container as the container is pushed into the dispensing, loading or unloading apparatus. The probes contact the internal release mechanism of the container and open the closure mechanism. In some cases, however, it is possible to partially open a container prior to inserting the container into a dispenser, permitting withdrawal of notes and then to allow the container to close leaving no indication that it has been opened. In some cases also it is possible to prevent closure of the closure mechanism during removal of the container.

A secure container according to the present invention, having an aperture and a closure member movable to cover or uncover the aperture, comprises actuating means for engagement by a releasing member, forming part of the dispensing, loading or unloading apparatus, as the container is inserted in the apparatus, a first mechanism operated by the actuating means upon such engagement to cause an internal member to move to a position in which it projects through the side of the container so as to prevent withdrawal of the container until the internal member is restored to its first position, and a second mechanism operated through a lost-motion arrangement by the actuating means to release the closure member only after the internal member has been moved to its projecting position.

In the preferred arrangement, the container also comprises a key-operated cocking mechanism such that the release mechanism for the closure member can act only when the cocking mechanism has been cocked, and such that when the closure member re-closes at the start of a withdrawal operation of the container, the cocking mechanism moves to an uncocked position in which subsequent re-opening of the closure member of the container is prevented until re-cocking has taken place.

In this preferred form, means are provided for the positive prevention of the withdrawal of the container from the dispensing, loading or unloading apparatus in the event of the closure member being jammed open.

Preferably the dispensing, loading or unloading apparatus is fitted with anti-pilfer plates which surround the container, ensuring that there is no access to the closure member when the container has reached a position such that further entry actuates the opening mechanism for the closure member.

In order that the invention may be better understood, one example of a container embodying the invention will now be described with reference to the accompanying drawings, in which.

In essence, the container comprises a cover opening mechanism indicated by parts 12, 21, 22 and 23; a key-operated cocking device illustrated by parts 1 to 8; and a lost motion coupling between a bar 10 and a bar 12 which operates the cover release mechanism.

Figure 2:
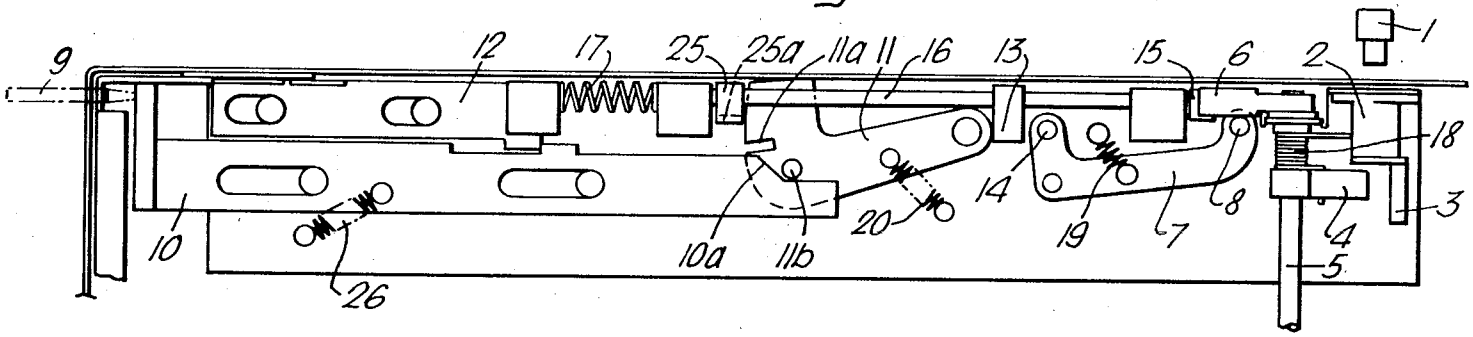
FIG. 2 is a plan view of parts of the apparatus shown in FIG. 1.

In greater detail, when a key 1 is inserted into a lock 2 and is turned 180° counterclockwise to cock the mechanism, crank arm 3 engages lever 4 and presses it down against the force of torsion spring 18. A shaft 5, to which the lever 4 is pinned, turns clockwise, lifting a pawl 6 out of the plane of the paper (FIG. 2). The movement of the pawl 6 allows a lever 7 to rotate counterclockwise under the action of a tension spring 19, with the result that a domed pin 8 on the lever 7 rides under the pawl 6 to hold it in its raised position. This is the cocked position of the cocking mechanism. The key 1 is then turned through 180° clockwise and is removed.

When the container is inserted into the dispensing apparatus, a probe 9 in the dispensing apparatus bears on the end of a bar 10. The initial travel of the container into the dispensing apparatus pushes bar 10, the cam surface **10*a* which acts on pin 11*b* to force a bell-crank lever 11** to project through the side of the container. The projecting portion of the lever makes it impossible both to insert the container into the dispenser with the lever protruding or to remove the container from the dispenser with the lever protruding.

Further movement of bar 10 by the probe 9 as the container is pushed further into the dispenser causes the bar 10 to contact and thereafter displace the bar 12 but only after all the "lost motion" available between the contact points has been used. Such movement of bar 12 acts through a lug **21*a*, a connecting pin 21 and a lever arm 22 operating about pivot point 23, to move a cover or door 24 to its open position, in which it uncovers an aperture 24*a*. The cover 24** will be fully open when the container (for example a banknote cassette) is safely housed in the dispenser.

As bar 12 moves backwards, a rod 16 moves with it. A block 13 rigidly fixed to the rod 16 bears on a pin 14 on the lever 7 and swings the lever 7 clockwise against the action of its tension spring 19. At the same time, a block 15 fixed to shaft 16 moves under the pawl 6 to hold it in its raised position in place of the domed pin 8, the pin 8 swinging out from under the pawl 6 with the rotation of the lever 7. This is the state with the cassette fully inserted into the dispenser. When withdrawal of the cassette from the dispenser takes place, the retraction of probe 9 enables bar 10 to move to the left in FIG. 1 under the action of a tension spring 26. Simultaneously, the bar 12 moves to the left under the influence of a compression spring 17, to the extent allowed by its contact with bar 10. The rod 16 moves with the bar 12, causing block 15 to move from under pawl 6, allowing the pawl to return behind block 15 under the action of the tension spring 18. The block 13 also moves away from the pin 14, allowing the lever 7 to rotate counterclockwise under the action of tension spring 19 until the domed pin 8 rests against the side of pawl 6.

Further movement of bar 12 causes closure of cover 24, through connecting pin 21 and lever arm 22.

When the cover has closed, the bar 12 reaches the end of its travel. The final portion of the withdrawal of the cassette allows bar 10 to move to its rest position. This permits lever 11 to withdraw into the cassette under the action of tension spring 20 and controlled by the cam surface 10*a*. The cassette may now be fully removed from the dispenser with the cover closed and the mechanism locked. It will be seen that the operation of the locking lever 11 is controlled by bar 10 in such a way that when the cassette is inserted into the dispenser, lever 11 is always in its fully projecting state before the remainder of the mechanism, including the cover release mechanism, is operated. On withdrawing the cassette from the container, the withdrawal of lever 11 into the container is the last occurrence before the cassette is removed; in other words, the cover release mechanism will already have operated to close the cover when lever 11 retracts. Once the cover is closed, any further attempt to open it is prevented because the cover opening would have to accompany movement of rod 16 to the right and this is prevented by the engagement of block 15 and pawl 6. Bar 10 and lever 11 can be moved, but this has no effect on the cover opening. Only the use of a key can re-cock the mechanism to permit re-entry of the cassette into the dispenser.

Thus, when the cocking mechanism is in a condition to allow the cover to be opened and the cassette is inserted into the dispenser the cocking mechanism is tripped to its locked state. An additional feature of the apparatus shown is provided by a slot 11*a* in lever 11 and a projection 25*a* on block 25. This improvement positively prevents the withdrawal of the cassette from the dispenser in the event of the door being jammed open. During the insertion of the cassette, a projection 25*a* from block 25 (mounted on rod 16) enters a slot 11*a*. When the cassette is withdrawn, if the door is jammed open, lever arm 22 will prevent bar 12 moving under the action of compression spring 17. The bar 10 will return under the action of tension spring 26 and cam surface 10*a* will leave pin 11*b* on lever 11. Thus lever 11 will be held in its projecting position, effectively locking the cassette in the dispenser.

Figure 3:
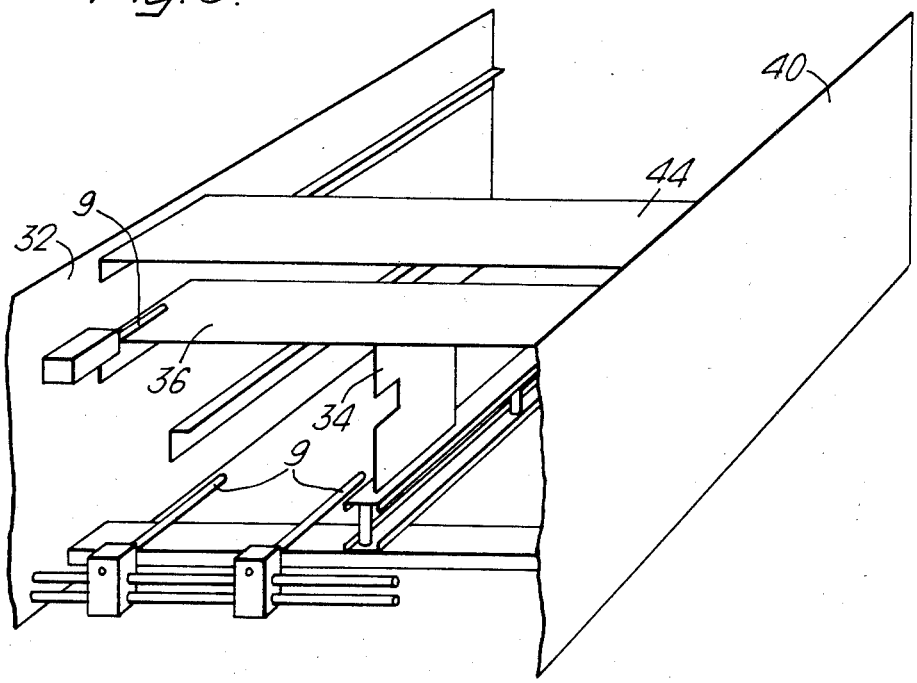
FIGS. 3 and 4 illustrate a dispensing apparatus into which dispensing cassettes embodying the invention, and a reject container of the kind shown in FIGS. 1 and 2, may be inserted.
Figure 4:
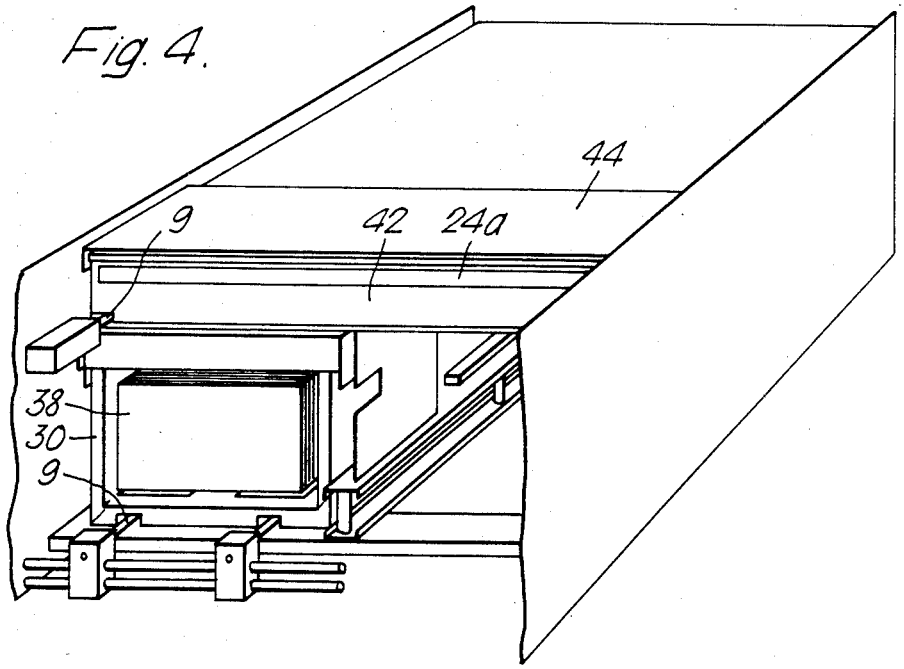

FIG. 3 illustrates a part of dispensing apparatus for housing two note-dispensing cassettes and a reject container. FIG. 4 shows the same parts of the dispensing apparatus with one cassette in place. This first cassette 30 lies between one side wall 32 of the dispensing apparatus and a central plate 34 and below a transverse plate 36. The two probes 9 are shown in full in FIG. 3 and the manner in which they extend into the cassette 30 can be seen from FIG. 4. In FIG. 4, a cover, in this case of the roller shutter kind, has been opened as a consequence of the movement of the cassette on to the probes 9, revealing the notes 38 to be dispensed.

The other cassette, not shown in the drawings, lies between the central plate 34 and the other side wall 40 of the dispensing apparatus, and again lies below the transverse plate 36. The probes for this cassette are not shown but are similar to those for the cassette 30.

Additionally, a reject container 42, FIG. 4, is inserted between the transverse plate 36 and an upper transverse plate 44. The reject container 42 serves for both cassettes and is similar in construction to the container illustrated in FIGS. 1 and 2. Its aperture 24*a* is shown in FIG. 4 and its probe 9 is visible in FIGS. 3 and 4.

In this dispenser, notes dispensed from an inserted cassette which are found to be unfit for issue are returned to the reject container 42.

Figure 1:
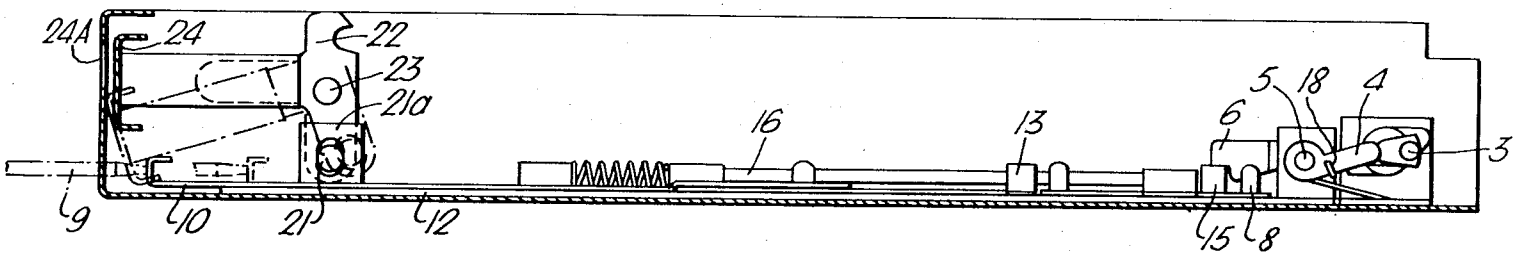
FIG. 1 shows a part of the container in side elevation with the side wall broken away.

The lost-motion mechanism for opening the cover of the cassette 30 embodies the invention and operates in the same general manner as that illustrated in FIGS. 1 and 2.

It will be seen that if anyone attempts to open the cover of a cassette or reject container embodying the invention while it is outside the dispensing apparatus, the lever 11 will be moved to project outside the cassette or reject container before any such opening can take place, and the lever cannot then be pushed back into the container. Additionally, the cover cannot be held open while the secure container is withdrawn from the dispensing apparatus.

The plate 34 shown in FIGS. 3 and 4 acts as an anti-pilfer plate, denying access to the cover of a cassette when the cassette is in a position where further insertion into the dispensing apparatus causes the cover to open.

We claim:

1. A secure container including a casing having an aperture, a closure device and closure-operating means for moving the closure device to cover or uncover the aperture, and actuating means for engagement by a releasing member forming part of a dispensing, loading or unloading apparatus as the container is inserted into the apparatus, the container further comprising;

a locking member mounted in the container and movable between a withdrawn position in which it lies entirely within the casing of the container and a locking position in which a part of the locking member projects through an opening in the casing of the container and prevents withdrawal of the container from the apparatus;

spring means urging the locking member towards one of its said positions;

means controlled by the actuating means for moving the locking member against the spring means to the other of its said positions;

and a lost-motion connection means coupling the actuating means to the closure-operating means for moving, the locking member to its locking position before the closure device is moved by the actuating means, through the closure-operating means, to its uncovering position, and on removal of the container from the apparatus for moving the locking member to its unlocking position after the closure-device has been restored to its covering position.

2. A container in accordance with claim 1, further comprising a key-operated cocking mechanism and means preventing the closure-operating member from opening the closure device until the cocking mechanism has been cocked.

3. A container in accordance with claim 2, including means restoring the cocking mechanism to an uncocked position when the closure-operating means restores the closure device to its covering position during withdrawal of the container from the apparatus, whereby subsequent movement of the closure device to its uncovering position is prevented until recocking has taken place.

4. A container in accordance with claim 1, including means controlled by the closure-operating means to latch the locking member in its locking position when the closure device is in its uncovering position, thereby preventing withdrawal of the container from the apparatus if the closure device is held open.

* * * * *